US005238198A

United States Patent [19]

Jingu et al.

[11] Patent Number: 5,238,198

[45] Date of Patent: Aug. 24, 1993

[54] AUTOMATIC TAKE-UP DEVICE FOR A CONTINUOUS SHEET OF PAPER

[75] Inventors: Toshihiro Jingu, Hiratsuka; Katsuyoshi Yokota, Kamakura, both of Japan

[73] Assignee: NCR Corporation, Dayton, Ohio

[21] Appl. No.: 627,165

[22] Filed: Dec. 13, 1990

[30] Foreign Application Priority Data

Dec. 15, 1989 [JP] Japan ..... 1-324180

[51] Int. Cl.[5] ..... B65H 23/04; B65H 23/28; B65H 75/24

[52] U.S. Cl. ..... 242/67.1 R; 242/76; 400/613

[58] Field of Search ..... 242/67.2, 67.1 R, 74, 242/72 R, 71.8, 195, 71.1, 76; 400/613

[56] References Cited

U.S. PATENT DOCUMENTS

| | | | |
|---|---|---|---|
| 1,631,432 | 6/1972 | Schuetz | 242/95 |
| 2,839,258 | 6/1958 | Jacobson | 242/72 |
| 2,943,807 | 7/1960 | Loop | 242/68.4 |
| 3,393,790 | 7/1968 | Dixon | 242/71.8 |
| 3,395,870 | 8/1968 | Klinger | 242/76 |
| 4,059,211 | 11/1977 | Brizzolara | 226/11 |
| 4,117,988 | 10/1978 | Moore | 242/71.8 |
| 4,136,839 | 1/1979 | Walter | 242/71.1 |
| 4,218,032 | 8/1980 | Nagel et al. | 242/74 |
| 4,244,535 | 1/1981 | Moodie | 242/71.8 |
| 4,396,164 | 8/1983 | Maeda et al. | 242/74.1 |
| 4,504,026 | 3/1985 | Serizawa et al. | 242/67.1 R |
| 4,629,136 | 12/1986 | Vallance | 242/71.8 |
| 4,844,369 | 7/1989 | Kanayachi | 242/56 R |
| 4,893,765 | 1/1990 | Randolph | 242/72 R |

FOREIGN PATENT DOCUMENTS

| | | | |
|---|---|---|---|
| 989799 | 5/1976 | Canada | 242/72 R |
| 2345259 | 3/1975 | Fed. Rep. of Germany | 242/67.1 R |

*Primary Examiner*—Daniel P. Stodola
*Assistant Examiner*—John Q. Nguyen
*Attorney, Agent, or Firm*—Craig E. Miller; Matthew R. Jenkins

[57] ABSTRACT

An automatic take-up device for automatically rolling and taking up a continuous sheet of paper on which transaction results are printed. The automatic take-up device comprises a take-up spool having a first flange member, a second flange member, and a take-up shaft for coupling the first and second flange members together. The automatic take-up device also includes a housing having a first wall and a second wall, each having a slot therein to enable the take-up spool to be detachably mounted in the housing. A guide module is coupled to the housing and guides the continuous sheet of paper around the take-up spool as the continuous sheet of paper is guided to and is caused to be wrapped around the take-up spool.

6 Claims, 4 Drawing Sheets

AUTOMATIC TAKE-UP DEVICE FOR A CONTINUOUS SHEET OF PAPER

BACKGROUND OF THE INVENTION

1. Field of the Invention

The present invention relates to an automatic take-up device for automatically winding and taking up a continuous sheet of paper on which transaction results are printed.

2. Description of the Related Art

A conventional automatic take-up device is shown in FIG. 5. A continuous sheet of paper A is guided upward (as viewed in FIG. 5) along a first guide plate D of a guide arm B to a guide module roller E which is also part of the guide arm B. The continuous sheet of paper A is conveyed from the guide module roller E to first guide module C. This take-up device includes a second guide arm F which is constructed similarly to the guide arm B. The first guide module C and a second guide module K are biased towards a take-up shaft G by springs H and I, respectively. The continuous sheet of paper A is conveyed by the clockwise rotation (as viewed in FIG. 5) of the take-up shaft G and the guide module roller E which rotates in accordance with the rotation of the take-up shaft G. This causes the continuous sheet of paper A to be conveyed along the guide plate D to the take-up shaft G. The continuous sheet of paper A is wound around the take-up shaft G from the tip of the first guide module C to a second guide module K of the second guide arm F. The continuous sheet of paper A is wound in a clockwise direction (as viewed in FIG. 5) from the second guide module K to the first guide module C. The continuous sheet of paper A is continuously taken up or rolled onto the take-up shaft G, thereby forming a paper roll.

At the completion of the take-up operation with the conventional take-up device, a flange member (not shown) which secures the paper roll to the take-up shaft G is detached from an end G-1 of the take-up shaft G. To remove the roll of continuous paper A, the guide arms B and F are extended upper-leftward and lower-rightward, as viewed in FIG. 5, respectively. The taken-up paper roll is then pulled off of the end of the take-up shaft G.

However, the conventional device has a number of drawbacks. Because it is necessary to provide the first and second guide arms B and F in two positions on the diagonal line centering on the take-up shaft G, the take-up device of the prior art necessarily uses an undesirable amount of space. In addition, when the take-up roll is detached from the take-up shaft G, it sometimes occurs that the most outer peripheral part of the paper roll gets caught, for example, on the guide module roller E or on the first and the second guide plates D and J. In order to prevent the above, the first and the second guide modules C and K must be simultaneously extended sufficiently upper-leftward and lower-rightward (as viewed in FIG. 5) in order to remove the paper roll from the take-up shaft G. Accordingly, removing the paper roll from take-up shaft G is cumbersome and time consuming. Also, removing the paper roll from the take-up shaft G is performed in an ATM (automated teller machine), for example, by pulling out a printer in the ATM which printer includes the take-up device. It is very hard for a service person to remove the paper roll from the take-up device because the ATM's are often placed in a narrow area, such as adjacent to a wall in a bank.

SUMMARY OF THE INVENTION

In order to solve the above-mentioned problems, there is provided an automatic take-up device for rolling a continuous sheet of paper into a roll, said automatic take-up device comprising: a take-up spool having a first flange member and a second flange member, said take-up spool also having a take-up shaft for coupling the first and the second flange members together; a housing having a first wall and a second wall, said first and said second walls each having a slot therein to enable the take-up spool to be detachably mounted in the housing; and a guide module coupled to the housing for guiding the continuous sheet of paper around the take-up spool as the continuous sheet of paper is guided to the automatic take-up device; said guide module cooperating with the take-up spool to cause the continuous sheet of paper to be rolled around the take-up shaft as the take-up spool rotates in the housing.

An object of the present invention is to provide an automatic take-up device which is relatively small in size and which is capable of winding a continuous sheet of paper in a roll which is large in outer diameter when taken up around a take-up spool in the automatic take-up device.

Another object of this invention is to provide means for permitting the roll of continuous sheet of paper to be removed from the take-up spool and the automatic take-up device with ease.

An advantage of this invention is that the structure only requires one guide module, thereby permitting a relatively small-sized device to take up a relatively large paper roll.

Yet another advantage of the automatic take-up device is that such device provides a take-up spool which can be easily removed from the automatic take-up device and which is designed to permit the paper roll to be easily removed from the take-up spool.

Still another advantage of the automatic take-up device is that the take-up spool can be accessed and handled from in front and above the automatic take-up device, thereby making it easy for a service person to quickly remove a paper roll from the automatic take-up device.

DESCRIPTION OF THE PREFERRED EMBODIMENT

Figure 1:
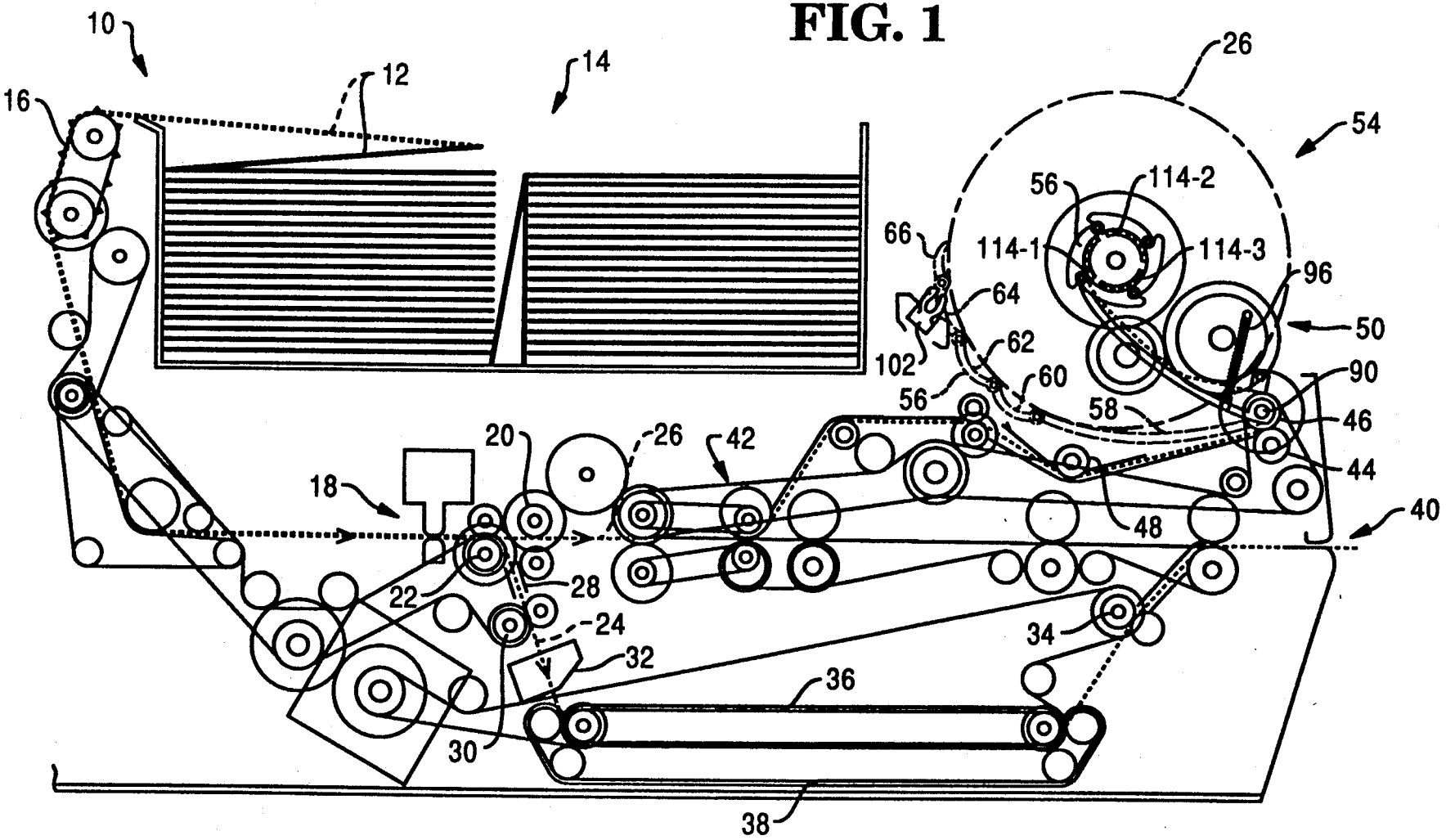
FIG. 1 is a side view of an automated teller machine, schematically showing a journal printer in the automated teller machine into which the automatic take-up device according to the present invention is incorporated.

FIG. 1 shows an automated teller machine, hereinafter designated ATM 10, in which the present invention may be used. FIG. 1 shows a two-ply continuous serial slip, hereinafter referred to as serial paper 12, which is stored in a paper supply area 14. The serial paper 12 is guided over a pin-feed tractor 16 and then is conveyed over various conventional rollers and pulleys, shown in FIG. 1, to a printer station 18. At the printer station 18, the results of a transaction or settlement are printed in a designated position (not shown) on the serial paper 12. At the completion of the printing operation, the serial paper 12 is guided onto a separation roller 20 after passing a conveyor roller 22. The separation roller 20 rotates in a counterclockwise direction (as viewed in FIG. 1) and causes the two plys of serial paper 12 to be separated into a serial receipt paper 24 and a serial journal paper 26.

The serial receipt paper 24 is guided by a guide plate 28 and conveyed onto a conveyor roller 30 and then to a cutter 32. The serial receipt paper 24 is cut off in a designated position by the cutter 32 to form a receipt (not shown) which is then conveyed onto a conveyor roller 34 after being pinched between a conveyor belt 36 and a conveyor belt 38. The receipt is conveyed through a plurality of belts and rollers, as shown in FIG. 1, after passing through the conveyor roller 34 and then the receipt until it ultimately is issued to a customer through a port 40.

Figure 2:
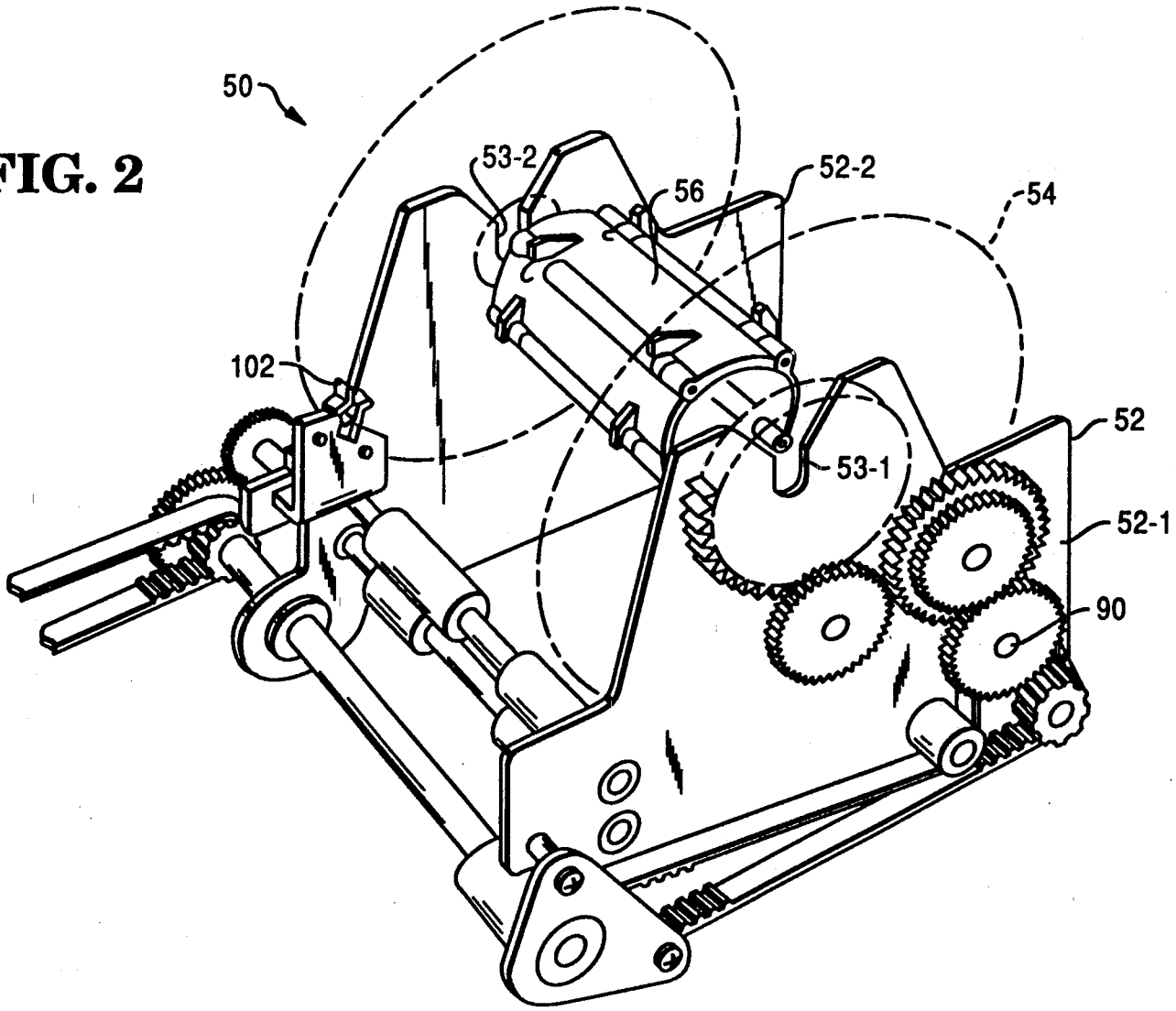
FIG. 2 is a fragmentary perspective view of an automatic take-up device according to the present invention.

The serial journal paper 26 which is separated by the separation roller 20 is conveyed to an imprint station 42. A customer card (not shown) is inserted by the customer through the port 40 and is conveyed to the imprint station 42 whereupon embossed characters or other customer data (not shown) on the card are imprinted onto the serial journal paper 26. As illustrated in FIGS. 1 and 2, various gears, belts and pulleys cooperate to move the serial journal paper 26 from the separation roller 20 to a guide roller 48. The serial journal paper 26 is guided over the guide roller 48 and conveyed between conveyor rollers 44 and 46 to an automatic take-up device 50.

FIG. 2 is a fragmentary perspective view of the take-up device 50. The take-up device 50 includes a housing 52, a take-up spool 54 and an articulated guide module 56. The housing 52 includes a first side wall 52-1 which is positioned in parallel with a second side wall 52-2. The first and the second side walls 52-1 and 52-2 are secured together by various shafts as shown.

The take-up spool 54 is rotated clockwise (as viewed in FIG. 2) by a drive motor (not shown) when the serial journal paper 26 (FIG. 1) is being rolled or taken up. The rate or speed of rotation of the take-up spool 54 varies with the speed at which the serial journal paper 26 is being fed thereto.

Figure 3:
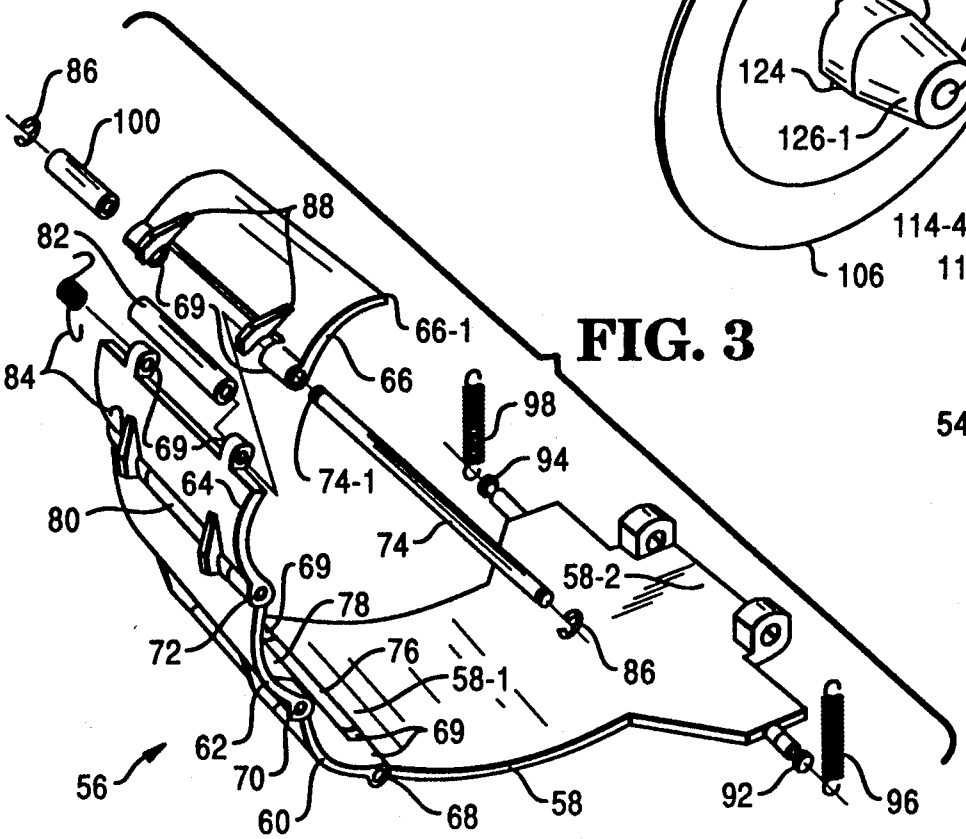
FIG. 3 is a broken-away exploded view of the articulated guide module used in the automatic take-up device shown in FIG. 2.
Figure 5:
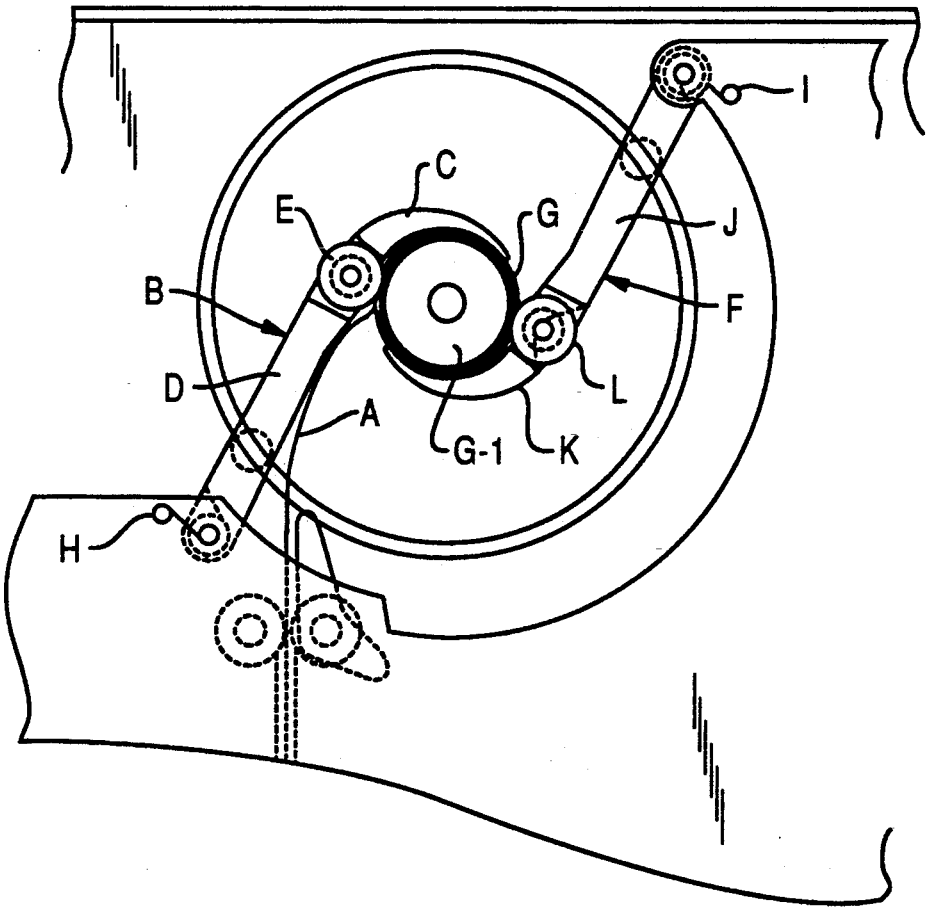
FIG. 5 PRIOR ART
FIG. 5 is a side view of an automatic take-up device in the prior art.

As best shown in FIG. 3, the guide module 56 comprises a first guide plate 58 for guiding the serial journal paper 26 to the take-up spool 54. A second guide plate 60 is pivotably connected between the first guide plate 58 and a third guide plate 62. The third guide plate 62 is also pivotably connected to a fourth guide plate 64 which in turn is coupled to a fifth guide plate 66, as illustrated in FIG. 3. The fifth guide plate 66 has a cross section (not shown) which becomes gradually thinner towards an end 66-1 thereof. This permits the serial journal paper 26 (FIG. 1) to be easily guided to the take-up spool 54.

As best illustrated in FIG. 3, a first shaft 68 is passed through holes or hinges 69 in the guide plates 58 and 60, thereby coupling the first guide plate 58 to the second guide plate 60. A second shaft 70 is passed through holes in the guide plates 60 and 62, thereby coupling the second guide plate 60 to the third guide plate 62. The third and the fourth guide plates 62 and 64 and the fourth and the fifth guide plates 64 and 66 are coupled together in a similar fashion by a third shaft 72 and a fourth shaft 74, respectively, as shown in FIG. 3. The shafts 68, 70, 72, and 74 have guide rollers 76, 78, 80, and 82, respectively, mounted as shown. The guide rollers 76, 78, 80 and 82 facilitate guiding the serial journal paper 26 around the take-up spool 54. A plurality of springs 84 are attached to each shaft 68, 70, 72, and 74 such that the guide plates 58, 60, 62, 64 and 66 are normally biased around the take-up spool 54, as shown in FIG. 1. The shafts 68, 70, 72 and 74 each have a pair of clips 86 at their ends to secure the guide plates 58, 60, 62, 64, and 66 in place. The guide plates 58, 60, 62, 64, and 66 each have a pair of pawls 88 to keep the guide plates from extending in a counterclockwise direction (as viewed in FIGS. 1, 2 and 3).

An end 58-1 of the first guide plate 58 is connected to the second guide plate 60, and another end 58-2 is pivotally attached onto a shaft 90 (FIGS. 1 and 2). Shaft parts 92 and 94 (FIG. 3) protrude from opposite sides of the first guide plate 58, as illustrated in FIG. 3. Tension springs 96 and 98 are spanned between the shaft parts 92 and 94, respectively, and associated studs (not shown) located on the first and the second side walls 52-1 (FIG. 2) and 52-2 of the housing 52. The guide module 56 (FIG. 3) is always biased toward the take-up spool 54 by the tension springs 96 and 98 when the take-up spool 54 is mounted in the housing 52.

A knob 100 (FIG. 3) is provided on an end 74-1 of the shaft 74. The knob 100 may be set in a knob receptor member 102 (FIGS. 1 and 2) which is provided on the second side wall 52-2, thereby causing the guide module 56 to be extended to an open position, as shown in phantom outline in FIG. 1. This facilitates removing the rolled serial journal paper 26 from the automatic take-up device 50.

Figure 4:
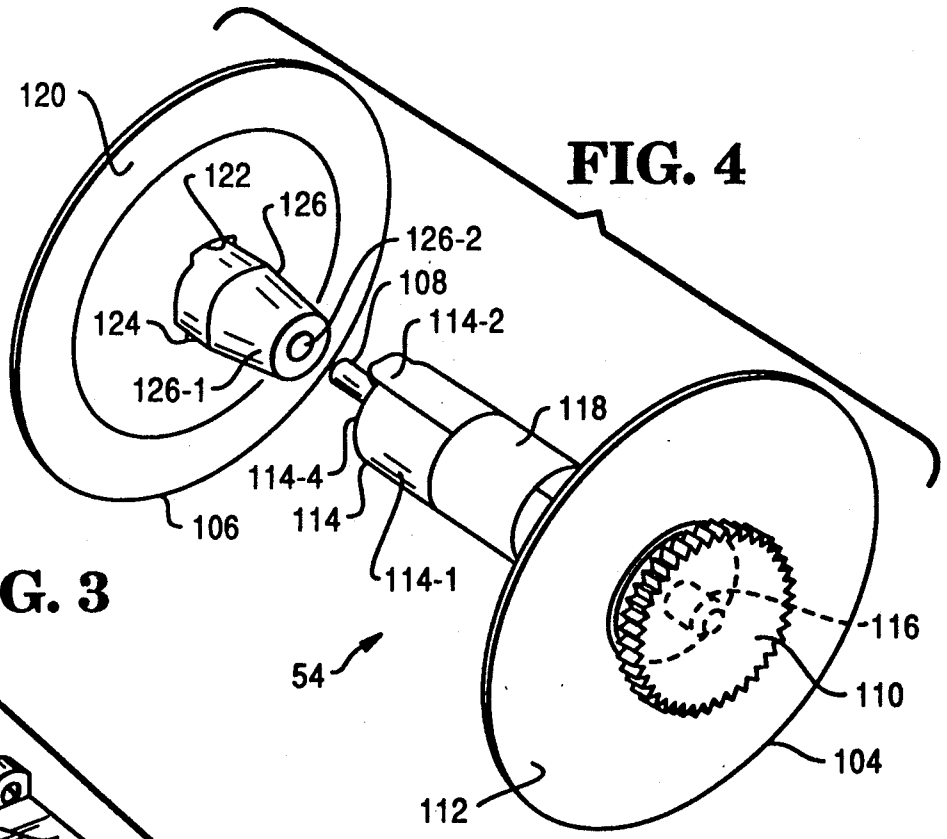
FIG. 4 is a perspective view of a take-up spool used in the automatic take-up device shown in FIG. 2.

Next, the structure of the take-up spool 54 will be described with reference to FIG. 4. The take-up spool 54 consists of a first flange member 104 and a second flange member 106. The first flange member 104 comprises a shaft 108, a gear 110, a flange 112, a take-up shaft 114 and a guide shaft 116. The take-up shaft 114 (FIG. 4) consists of parts 114-1, 114-2 and 114-3 having spaces therebetween as best shown in FIG. 1. An elastic friction member 118 extends slightly beyond the circumferential surface of the parts 114-1, 114-2 and 114-3 of the take-up shaft 114. The second flange member 106 comprises a flange 120, which has a pair of slots or holes 122 and 124. The hole 122 cooperates with the part 114-2 to couple the first and the second flange members 104 and 106 together. The hole 124 also cooperates with a similar part (not shown) as part 114-2 on the underside (as viewed in FIG. 4) of the take-up shaft 114. A tapered core shaft 126 having a tapered end 126-1 is also secured to the flange 120, as shown in FIG. 4, and a guide shaft (not shown) is secured to the opposite side (as viewed in FIG. 4) of the flange 120. The tapered core shaft 126 cooperates with a tapered opening (not shown) at an end 114-4 of the take-up shaft 114. The guide shaft (not shown) on flange 120 and the guide shaft 116 enable the take-up spool 54 to be rotatably mounted in bearings (not shown) in a pair of slots 53-1 (FIG. 2) and 53-2 located in side walls 52-1 and 52-2, respectively.

The second flange member 106 (FIG. 4) is detached from the first flange member 104 when it is desired to remove the serial journal paper 26 from the take-up shaft 114. As the shaft 108 is dismounted or pulled away from an opening 126-2 of the tapered core shaft 126, the parts 114-1, 114-2 and 114-3 become compressed towards each other by the force of the elastic friction member 118, thereby causing the outer diameter of the take-up shaft 114 to become reduced. This facilitates removing the roll of serial journal paper 26 from the take-up shaft 114. When the second flange member 106 is coupled to the take-up shaft 114, the tapered end 126-1 of the tapered core shaft 126 is inserted into the opening (not shown) at the end 114-4. The tapered core shaft 114 causes the parts 114-1, 114-2 and 114-3 to expand away from each other as the tapered end 126-1 is inserted into the end 114-4, thereby causing the outer diameter of the take-up shaft 114 to increase. As the part 114-2 is guided into the hole 122 and the take-up shaft 114 is forced onto the tapered core shaft 126, the second flange member 106 becomes secured to the first flange member 104.

Next, the winding and take-up operation of the serial journal paper 26 will be described. The take-up spool 54 is first rotatably mounted in the slots 53-1 and 53-2 (FIG. 2) of side walls 52-1 and 52-2, respectively. The knob 100 (FIG. 3) of the guide module 56 is detached from the knob receptor member 102 (FIGS. 1 and 2). When the knob 100 is lifted upward away from the knob receptor member 102 in a clockwise manner (as viewed in FIG. 1), the first guide plate 58 swings (FIG. 3) about the take-up shaft 114 by the actions of the springs 96 and 98 (FIG. 3) until the first guide plate 58 comes into contact with the take-up shaft 114 (FIG. 4). As the knob 100 is released, the guide plates 60, 62, 64 and 66 are biased to wrap around the take-up shaft 114 by the force of the springs 84, as best illustrated in FIGS. 1 and 2.

The serial journal paper 26 (FIG. 1) on which transaction data (not shown) has been printed at the printer station 18 is conveyed from the paper supply area 14 to the conveyor rollers 44 and 46. The conveyor rollers 44 and 46 convey the serial journal paper 26 along the first guide plate 58 (FIG. 3) until the leading edge (not shown) of the serial journal paper 26 contacts the guide roller 76 (FIG. 3) which is provided at the end 58-1 of the first guide plate 58. The guide roller 76 engages the serial journal paper 26 against the take-up shaft 114 of the take-up spool 54. As the take-up spool 54 rotates clockwise (as viewed in FIG. 1), the guide roller 76 is rotated counterclockwise. This causes the serial journal paper 26 to be conveyed clockwise along the other guide plates 60, 62, 64, and 66 until the serial journal paper 26 is wound along the outer periphery of the take-up shaft 114. The slippage or idling of the serial journal paper 26 thus wound around the take-up shaft 114 is prevented by the elastic friction member 118 (FIG. 4). The serial journal paper 26 is wound around the outer periphery of the take-up shaft 114 as the take-up spool 54 is rotated by the drive motor (not shown).

The serial journal paper 26 is taken up on the take-up spool 54 after the completion of each transaction, and the diameter of the rolled serial journal paper 26 gradually increases. As the diameter of the roll of serial journal paper 26 increases, the guide module 56 gradually expands to an open position, as best illustrated in phantom outline in FIG. 1. When the diameter of the rolled serial journal paper 26 reaches a predetermined size, as shown in phantom in FIG. 1, a sensor (not shown) is activated to notify an operator that the roll of serial journal paper 26 needs to be detached. Next, the detachment of the rolled serial journal paper 26 will be described.

The knob 100 (FIG. 3) of the guide module 56, which is extended along the outside of the rolled serial journal paper 26, is lifted up in a counterclockwise direction (as viewed in FIGS. 1 and 2). The knob 100 is fitted and secured into the knob receptor member 102 (FIGS. 1 and 2). The take-up spool 54 can now be lifted upward (as viewed in FIG. 2) away from the slots 53-1 and 53-2 in the side walls 52-1 and 52-2, respectively. Once removed from the housing 52, the second flange member 106 (FIG. 4) can be pulled in the axial direction away from the first flange member 104, thereby separating the first and the second flange members 104 and 106. As mentioned previously herein, the outer diameter of the take-up shaft 114 becomes reduced by the contraction of the elastic friction member 118 as the tapered core shaft 126 is pulled away from the take-up shaft 114, thereby facilitating removal of the rolled serial journal paper 26 from the take-up shaft 114.

At the completion of the detachment of the rolled serial journal paper 26, the first and the second flange members 104 and 106 can be reunited in the manner described earlier herein. The take-up spool 54 can again be positioned in the slots 53-1 and 53-2 of the side walls 52-1 and 52-2, respectively, where the spool 54 can take-up another roll of serial journal paper 26.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. An automatic take-up device for rolling a continuous sheet of paper into a roll, said automatic take-up device comprising:

a take-up spool having a first flange member and a second flange member, said take-up spool also having a detachable take-up shaft for coupling said first flange member and said second flange member together, said take-up shaft having a center axis;

a housing having a first wall and a second wall, each of said first wall and said second wall having a slot herein to enable said take-up spool to be detachably mounted in said housing;

a guide module coupled to said housing for guiding said continuous sheet of paper around said take-up spool as said continuous sheet of paper is guided to said automatic take-up device;

said guide module having a first guide plate, at least one middle guide plate, and a last guide plate, said first guide plate, said at least one middle guide plate, and said last guide plate each having at least one hinge thereon for pivotally coupling said first guide plate, said at least one middle guide plate, and said last guide plate;

coupling means for coupling said first guide plate, said at least one middle guide plate, and said last guide plate, said coupling means having a plurality of shafts which can be individually inserted into said at least one hinge of each of said first guide plate, said at least one middle guide plate, and said last guide plate to pivotally secure said first guide plate, said at least one middle guide plate, and said last guide plate together end-to-end;

said first guide plate, said at least one middle guide plate, and said last guide plate each including a pawl for precluding said first guide plate, said at least one middle guide plate, and said last guide plate from pivoting beyond a predetermined amount in a direction away from said take-up spool;

resilient means for resiliently biasing said first guide plate, said at least one middle guide plate, and said last guide plate towards and around said center axis of said take-up shaft;

said resilient means including at least one spring mounted on each of said first guide plate, said at least one middle guide plate, and said last guide plate to bias said first guide plate, said at least one middle guide plate and said last guide plate towards said take-up spool;

said first guide plate, said at least one middle guide plate and said last guide plate each having a front surface which engages with the roll, and a back surface, and said pawl extends outwardly away from said back surface of each of said first guide plate, said at least one middle guide plate, and said last guide plate and over said at least one hinge of each of said first guide plate, said at least one middle guide plate, and said last guide plate to contact the back surface of the adjacent guide plate to preclude said first guide plate, said at least one middle guide plate, and said last guide plate from pivoting beyond a predetermined amount away from said take-up spool; and said guide module cooperating with said take-up spool to cause the continuous sheet of paper to be rolled around said take-up shaft as said take-up spool rotates in said housing.

2. The automatic take-up device in accordance with claim 1, wherein:

said take-up shaft has a first end secured to said first flange and a second end; and said second flange has a tapered core shaft secured thereto, said tapered core shaft cooperating with said second end of said take-up shaft to secure said first flange and said second flange together.

3. The automatic take-up device in accordance with claim 2, wherein:

said take-up shaft has an outside diameter and includes a first part, a second part, and a third part; and said take-up shaft further includes an elastic friction member secured thereto to force said first part, said second part, and said third part around said second end of said take-up shaft when said first flange is mounted to said second flange and also to reduce said outside diameter of said take-up shaft when said first flange is uncoupled from said second flange, thereby permitting the roll to be removed from said take-up shaft.

4. A printer terminal having a print station, said printer terminal comprising:

a terminal frame;

a recorder mounted in said terminal frame at said print station for printing data on a continuous sheet of paper;

an automatic take-up device mounted in said terminal frame for rolling said continuous sheet of paper into a roll;

conveying means operatively associated with said terminal frame for conveying said continuous sheet of paper from a paper supply to said recorder and then to said automatic take-up device;

said automatic take-up device including:

a take-up spool having a first flange member and a second flange member, said take-up spool also having a detachable take-up shaft for coupling said first flange member and said second flange member together, said take-up shaft having a center axis;

a housing having a first wall and a second wall, each of said first wall and said second wall having a slot therein to enable said take-up spool to be detachably mounted in said housing;

a guide module coupled to said housing for guiding said continuous sheet of paper around said take-up spool as said continuous sheet of paper is guided to said automatic take-up device;

said guide module having a first guide plate, at least one middle guide plate, and a last guide plate, said first guide plate, said at least one middle guide plate, and said last guide plate each having at least one hinge thereon for pivotally coupling said first guide plate, said at least one middle guide plate, and said last guide plate;

coupling means for coupling said first guide plate, said at least one middle guide plate, and said last guide plate, said coupling means having a plurality of shafts which can be individually inserted into said at least one hinge of each of said first guide plate, said at least one middle guide plate, and said last guide plate to pivotally secure said first guide plate, said at least one middle guide plate, and said last guide plate together end-to-end;

said first guide plate, said at least one middle guide plate, and said last guide plate each including a pawl for precluding said first guide plate, said at least one middle guide plate, and said last guide plate from pivoting beyond a predetermined amount in a direction away from said take-up spool;

resilient means for resiliently biasing said first guide plate, said at least one middle guide plate, and said last guide plate towards and around said center axis of said take-up shaft;

said resilient means including at least one spring mounted on each of said first guide plate, said at least one middle guide plate, and said last guide plate to bias said first guide plate, said at least one middle guide plate, and said last guide plate towards said take-up spool;

said first guide plate, said at least one middle guide plate and said last guide plate each having a front surface which engages with the roll, and a back surface, and said pawl extends outwardly away from said back surface of each of said first guide plate, said at least one middle guide plate, and said last guide plate and over said at least one hinge of each of said first guide plate, said at least one middle guide plate, and said last guide plate to contact the back surface of the adjacent guide plate to preclude said first guide plate, said at least one middle guide plate, and said last guide plate from pivoting beyond a predetermined amount away from said take-up spool; and said guide module cooperating with said take-up spool to cause the continuous sheet of paper to be rolled around said take-up shaft as said take-up spool rotates in said housing.

5. The automatic take-up device in accordance with claim 4, wherein:

said take-up shaft has a first end secured to said first flange and a second end; and said second flange has a tapered core shaft secured thereto, said tapered core shaft cooperating with said second end of said take-up shaft to secure said first flange and said second flange together.

6. The automatic take-up device in accordance with claim 3, wherein:

said take-up shaft has an outside diameter and includes a first part, a second part, and a third part; and said take-up shaft further includes an elastic friction member secured thereto to force said first part, said second part, and said third part around said second end of said take-up shaft when said first flange is mounted to said second flange and also to reduce said outside diameter of said take-up shaft when said first flange is uncoupled from said second flange, thereby permitting the roll to be removed from said take-up shaft.

* * * * *

UNITED STATES PATENT AND TRADEMARK OFFICE

CERTIFICATE OF CORRECTION

PATENT NO. : 5,238,198

DATED : August 24, 1993

INVENTOR(S) : Toshihiro Jingu et al.

It is certified that error appears in the above-identified patent and that said Letters Patent is hereby corrected as shown below:

Column 6, line 46, delete "herein" and substitute --therein--.

Column 9, line 12, delete "3" and substitute --5--.

Signed and Sealed this

Thirty-first Day of May, 1994

*Attest:*

Bruce Lehman

BRUCE LEHMAN

*Attesting Officer*

*Commissioner of Patents and Trademarks*